United States Patent [19]

Romero et al.

[11] 4,180,054

[45] Dec. 25, 1979

[54] TRAY FOR INCREASING WAX IMPREGNATED LOG BURNING LIFE

[76] Inventors: Frank Romero; Joanne L. Gardiner-Romero, both of P.O. Box 4791, Hayward, Calif. 94540

[21] Appl. No.: 957,498

[22] Filed: Nov. 3, 1978

[51] Int. Cl.[2] ..... F23H 13/00

[52] U.S. Cl. ..... 126/164; 126/152 B; 126/127; 44/35

[58] Field of Search ..... 126/164, 152 R, 165, 126/298, 263, 336, 152 B, 163 R, 148; 431/125, 289, 291, 292; 44/35

[56] References Cited

U.S. PATENT DOCUMENTS

| | | | |
|---|---|---|---|
| 3,089,760 | 5/1963 | Jaffe | 44/35 |
| 3,385,651 | 5/1968 | Rasmussen et al. | 126/127 |
| 3,671,175 | 6/1972 | Campbell | 126/127 |
| 3,871,355 | 3/1975 | Henry | 431/125 |

*Primary Examiner*—James C. Yeung

*Attorney, Agent, or Firm*—Townsend and Townsend

[57] ABSTRACT

A device and method for extending the burning time of wax synthetic logs and for reducing the amount of smoke, odor and residue. The device comprises a sloping tray having a lower edge facing the front of the fireplace and an upper edge toward the rear of the fireplace, a first upper flange along the upper edge of the tray to deflect air around toward the ends and front of the log, and a second lower flange along the lower edge of the tray. A log is placed on the sloping tray with its axis parallel to the flange, and ignited in the normal manner. The second flange, in addition to preventing the log from rolling forward, defines a region into which molten wax from the combustion of the log flows to form a reservoir and provides an air space above the surface of the molten wax such that air deflected by the first flange enters the air space to promote burning along the front and top portions of the log. A lip on the lower flange further defines the reservoir and air space.

10 Claims, 4 Drawing Figures

TRAY FOR INCREASING WAX IMPREGNATED LOG BURNING LIFE

This invention relates generally to fireplace devices, and more specifically to devices for supporting artificial wax impregnated logs during burning.

BACKGROUND OF THE INVENTION

Beginning with cavemen huddled around their open fires, countless generations have derived warmth and security from wood fires. This tradition has been carried forward into the modern home, where the burning logs in the fireplace often provide figurative warmth in excess of the actual caloric content of the fuel. As firewood has become increasingly expensive and difficult to obtain, people have turned to burning synthetic fire logs in their fireplaces. One common type of synthetic log is fabricated from a mixture composed of up to 60% wax and 40% sawdust or other fibers.

While synthetic logs of the wax variety are highly satisfactory in producing a visually acceptable fire, they are still possessed of certain problems that often render their use less than wholly satisfactory. As the log burns, the heat causes wax in the log to melt and run out of the log. As the molten wax drips down beneath the burning log, toward the fireplace floor, it burns in a generally uncontrolled manner, sometimes splattering globules of burning wax around the fireplace area in a dangerous manner. The log is consumed in a relatively short time, often breaking apart in the process. The burning log thus generates a considerable amount of smoke, odor, and residue. Additionally, while some logs are treated to provided colored flames, the high temperatures resulting from the uncontrolled burning reduce the effectiveness of the treatment, causing the colors to be produced over only a small part of the burning cycle.

Nevertheless, wax impregnated synthetic fire logs have found widespread use, to the point where approximately 72,000,000 such logs are consumed annually in the United States. In fact, the demand is such that production of the wax, originally considered a waste product from oil refining operations, must be supplemented by resort to more expensive sources. The problems, including short burning life, large smoke production, and possible dangers from the uncontrolled burn have been accepted as inevitable.

SUMMARY OF THE INVENTION

The present invention provides a device and a method for increasing the burning time of wax synthetic logs and for providing a fire that burns at a relatively even rate throughout the entire life of the log with a reduced amount of smoke, odor, and residue.

A device according to the present invention is normally placed in a fireplace, and comprises a sloping tray having a lower edge facing the front of the fireplace and an upper edge toward the rear of the fireplace, a first upper flange along the upper edge of the tray to deflect air over the top of the log and around toward the ends and front of the log, and a second lower flange along the lower edge of the tray. A log is placed on the sloping tray with its axis parallel to the flange, and ignited in the normal manner. The lower flange, in addition to preventing the log from rolling forward, defines a region into which molten wax from the combustion of the log flows to form a reservoir and provides an air space above the surface of the molten wax such that air deflected by the first flange enters the air space to promote burning along the front and top portions of the log, utilizing wax that would otherwise be wasted. The angle at which the tray slopes is sufficiently steep that molten wax coming out of the log flows toward the lower flange, but not so steep that the wax flows in an uncontrolled manner and runs out at the ends of the tray. For the type of wax in common use in synthetic logs, a slope of approximately one part in four has been found suitable to maintain a wax reservoir having a depth generally in the range $\frac{1}{8}$ inch to $\frac{1}{4}$ inch. The angle between the lower flange and the tray in normally required to be no more than 90° in order to maintain the reservoir and air space so that burning proceeds in a controlled and complete manner. It has generally been found desirable to provide the lower flange with a rearwardly and downwardly turned lip to further define the reservoir and air space.

The fire that results in primarily confined to the front-facing and top portions of the log, and combustion occurs in a controlled and substantially uniform manner. It has been found that a synthetic log that is burned according to the present invention has a life of at least 1–2 hours longer than when burned in a normal manner, as for example on a regular grate or andirons. The results are an economic saving to the user who uses fewer logs, and an ecological benefit due to the decreased amount of natural materials required. Additionally, less smoke, odor, and residue are produced since the combustion of the log using the present invention is more complete than that which occurs without using the invention. The invention further allows specially color-treated logs to produce vivid colors for a longer period of time than if the invention were not used.

For a further understanding of the nature and advantages of the present invention, reference should be had to the ensuing specification and attached drawings.

DESCRIPTION OF THE PREFERRED EMBODIMENT

Figure 1:
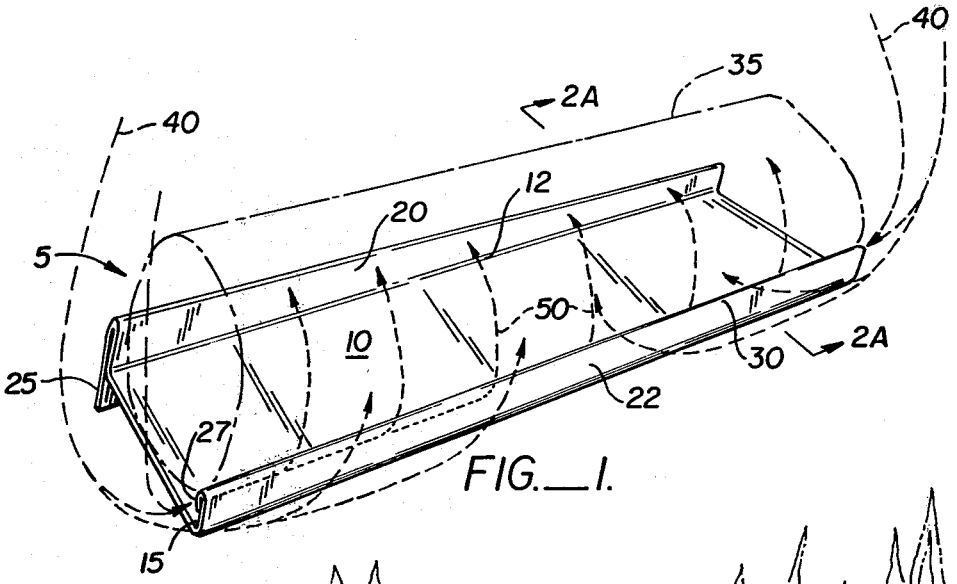
FIG. 1 is a perspective view of a device according to the present invention.

FIG. 1 is a perspective view of a device 5 constructed according to the present invention. A sloping tray 10 is defined by an upper edge 12 and a lower edge 15. In normal use, upper edge 12 is proximate the rear of a fireplace while lower edge 15 is proximate the front, edges 12 and 15 extending transversely within the fireplace. First and second upwardly protruding flanges 20 and 22 extend along respective edges 12 and 15. Tray 10 is maintained in its sloping configuration by a supporting member 25, which in the preferred embodiment is a downward extension of upwardly protruding flange 20. Member 25 preferably extends the entire transverse dimension of tray 10. Flange 22 is provided with a downwardly and rearwardly folded lip 27, thereby defining an upper edge 30. Lip 27 extends the entire transverse dimension of flange 22. Device 5 is preferably integrally fabricated from sheet metal such as 20 gauge cold rolled steel. Protection against rusting may be achieved by coating the metal with paint, as for example by an electro-deposition technique. The dimensional relationships among the various components can best be understood after a discussion of the operation of device 5.

Figure 2A:
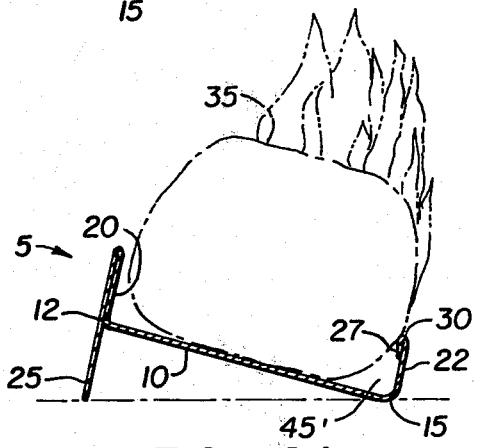
FIG. 2A is a sectional view taken along line 2A—2A of FIG. 1, showing schematically the combustion of a log at an early stage of the burning cycle.
Figure 2B:
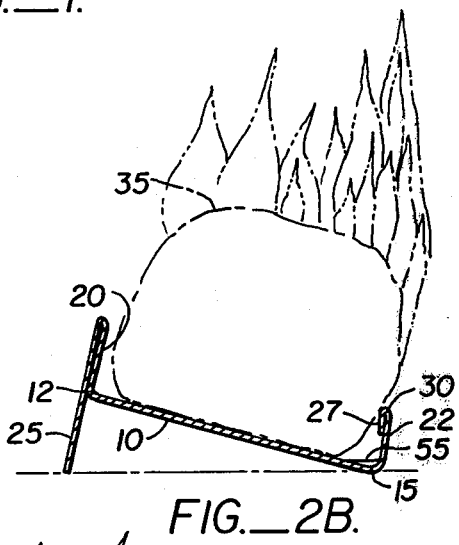
FIG. 2B is a cross-sectional view taken along line 2A—2A of FIG. 1 showing schematically the combustion at a later stage of the cycle when a wax reservoir has accumulated.
Figure 2C:
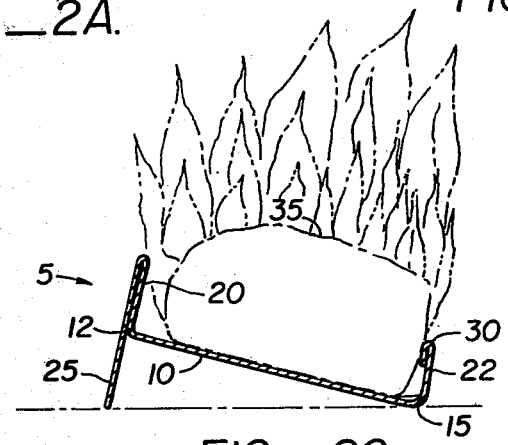
FIG. 2C is a sectional view taken along line 2A—2A of FIG. 1 showing schematically the combustion at an advanced stage of the burning cycle.

In operation, device 5 is placed in a fireplace with upper edge 12 towards the rear of the fireplace and lower edge 15 extending transversely near the front of the fireplace. A log 35, shown in phantom, is placed transversely on tray 10, being prevented from rolling forward by second flange 22. Log 35 is a synthetic log of the type whose composition includes up to 60% slack wax, the remaining constituents typically being sawdust and a paper wrapper. Suitable synthetic fire logs for use with the present invention are marketed under the trademarks DURAFLAME and SURE-FIRE among others. Log 35, often fabricated with a non-circular cross section to prevent rolling, is placed on tray 10 and ignited according to the manufacturer's instructions. Initially, as indicated in FIG. 2A, the log begins to burn on its top and front portions. However, first flange 20 is of a sufficient height to deflect air away from the rear and bottom-facing portions of log 35. Accordingly, combustion occurs primarily along the front-facing and top-facing portions of log 35. Front flange 22 and lip 27 in cooperation with tray 10 and lower portions of log 35 define an air space 45, such that air deflected by rear flange 20 and supporting member 25 flows in a transverse direction outwardly, around the end of log 35, and into air space 45. This is denoted schematically in FIG. 1 by arrows 40. The natural draft caused by combustion of log 35 causes the air within air space 45 to flow upwardly along the front and top-facing portions of log 35, as denoted schematically by arrows 50. Accordingly, once combustion is established, the draft tends to maintain the flow of air to promote burning primarily along the front-facing and top-facing portions. When combustion has been ongoing for a short period of time, the heat causes wax within the log to melt and flow out of the log. The slope of tray 10 causes the wax to accumulate across the bottom of air space 45, forming a reservoir of molten wax 55, as indicated in FIG. 2B. The presence of molten wax reservoir 55 and the draft at air space 45 further promotes burning along the front-facing portions of log 35. As portions of the log are consumed, the remaining portions move downward, and ultimately burning at the rear-facing portions occurs due to the lack of separation between the front and rear portions of the log. This is shown in FIG. 2C.

In view of the above-described operation of the present invention, the dimensional constraints may now be understood. The angle of slope is chosen to be sufficiently steep that molten wax flows downwardly and accumulates in reservoir 55 and further such that unburnt portions of the log are able to move downwardly as the front and top portions are consumed. At the same time, the slope must be sufficiently gentle that the flow of wax is a relatively slow one to maintain a controlled burn. The type of wax used in most synthetic fire logs of this variety, so-called slack wax, is a heavy wax which, when molten, is still relatively viscous. Accordingly, with the type of wax envisioned, a slope of approximately one part in four has been found to provide a proper controlled flow.

The angle between rear flange 20 and tray 10 is not critical, but flange 20 must protrude upwardly a sufficient distance to effectively shield the rear and lower portions of log 35. The height therefore depends on the distance between flange 20 and log 35, and therefore on the distance between upper and lower edges 12 and 15. Given a desire to provide a compact device, it has been found that a separation between edges 12 and 15 of approximately 4 inches with a height of flange 20 of approximately 1 inch provide suitable draft deflection characteristics. For ease of fabrication and effectiveness of diverting the air flow, flange 20 and support 25 are perpendicular to tray 10, and extend approximately one inch in either direction therefrom.

The configuration of front flange 22 is considerably more critical since air space 45 and reservoir 55 must be maintained. In particular, the angle between flange 22 and tray 10 should be no more than 90 degrees. Downwardly folded lip 27 on the rearwardly-facing side of flange 22 further serves to define and maintain air space 45 and reservoir 55.

Testing of device 5 according to the present invention has been conducted in the environment of the standard brick fireplace. Logs of the aforementioned varieties were burned without using device 5 and under the same circumstances using the device. In each case, use of device 5 resulted in a burning duration of at least 1–2 hours longer than the manufacturer's indicated maximum time. Without device 5, the burning never appreciably exceeded the manufacturer's maximum indicated time, and was normally of a lesser duration. Use of device 5 reduced substantially the amount of smoke, odor, and residue from the burning logs, and produced a comparatively more vividly colored and even fire. Additionally, device 5 held the log together during the entire combustion period, thus avoiding the fire hazards arising from splattering wax and log disintegration.

It can thus be seen that the present invention provides the user with numerous economic, ecological, and esthetic advantages. While the above provides a full and complete disclosure of the preferred embodiments of the invention, various modification, alternate constructions and equivalents may be employed without departing from the true spirit and scope of the invention. Therefore, the above description and illustrations should not be construed as limiting the scope of the invention, which is defined by the appended claims.

What is claimed is:

1. A device for increasing the burning life in a fireplace fire of an artificial log of the type having as part of its composition a wax material, comprising:

a sloping tray having an upper edge normally toward the rear of the fireplace and a lower edge normally toward the front of the fireplace and extending transversely from one end of the log to the other, the tray enabling the log to substantially maintain structural integrity during combustion;

means proximate the upper edge of the tray for diverting air away from the rear-facing portions of the log;

means proximate the lower edge of the tray for defining a region into which molten wax from combustion of the log may flow, and for maintaining an air space above the surface of the molten wax such that air deflected by the air deflection means enters the air space causing the log to burn primarily along front-facing and top-facing portions thereof, thereby extending the duration of the combustion and promoting complete combustion to reduce the amount of residue, smoke, and odor due to unburned wax.

2. The invention of claim 1 wherein the air deflection means comprises a generally upwardly protruding flange extending along the upper edge for substantially the entire transverse dimension of the tray.

3. The invention of claim 1 wherein the means for defining the region into which wax may flow and for providing the air space comprises a generally upwardly protruding flange extending along the lower edge of the tray.

4. The invention of claim 3 wherein the angle between the second flange and the tray is at most 90°.

5. The invention of claim 3 wherein the flange extending along the lower edge of the tray has an upper edge, and carries a convolute lip along the upper edge, the lip being directed downwardly and toward the air deflection means to further define the air space.

6. A device for supporting a burning artificial log of the type which includes a significant amount of wax comprising:

a sloping tray having a lower transverse edge and an upper transverse edge;

a first upwardly protruding flange extending along the upper edge of the tray, the first flange having a sufficient height to substantially divert air from flowing to rear-facing and bottom-facing portions of the log during a major interval of the combustion of the log;

a second upwardly protruding flange extending along the lower edge of the tray, the second flange defining an angle between the tray and the flange of at most 90°, the second flange having a sufficient height to retain a reservoir of molten wax produced during combustion of the log and to maintain an air space above the surface of the wax reservoir, the air space being open proximate the ends of the log so that air deflected by the first flange enters the air space and passes upwardly along front-facing and top-facing portions of the log to promote combustion therealong;

whereby combustion of the log occurs primarily along the front-facing and top-facing portions thereof, continuing to burn down through the log, thereby reducing the amount of unburned material and extending the duration of the combustion.

7. The invention of claim 6 wherein the second flange has an upper edge having a convolute fold along the upper edge, the fold being directed toward the first flange to further define the air space.

8. The invention of claim 6 wherein the tray has a slope of approximately 1 part in 4.

9. The invention of claim 6 wherein the device is integrally formed from a sheet of metallic material.

10. A method of increasing the burning life in a fireplace fire of an artificial log of the type having as part of its composition a wax material, comprising the steps of:

supporting the log horizontally and transversely in the fireplace;

deflecting air flow from rear and bottom portions of the log and permitting the deflected air to flow around ends of the log;

receiving molten wax from the burning log and maintaining the molten wax in a reservoir proximate the front portions of the log;

maintaining an air space above the reservoir so that the deflected air flowing around the ends of the log enters the air space and flows upwardly along the front portions of the log, promoting combustion therealong to produce a controlled fire of increased duration.

* * * * *